United States Patent [19]

Ikonomou

[11] Patent Number: 4,554,767

[45] Date of Patent: Nov. 26, 1985

[54] EARTHQUAKE GUARDING SYSTEM

[76] Inventor: Aristarchos S. Ikonomou, 90 Evrou St., Athens 609, Greece

[21] Appl. No.: 611,751

[22] Filed: May 18, 1984

Related U.S. Application Data

[63] Continuation of Ser. No. 231,754, Feb. 5, 1981, abandoned, which is a continuation-in-part of Ser. No. 201,803, Oct. 29, 1980, abandoned.

[51] Int. Cl.[4] ..... E04B 1/98

[52] U.S. Cl. ..... 52/167

[58] Field of Search ..... 52/167; 16/52, 51; 293/107; 188/322.22, 311.11

[56] References Cited

U.S. PATENT DOCUMENTS

| | | | |
|---|---|---|---|
| 1,572,574 | 2/1926 | Stromborg | 52/167 |
| 2,055,000 | 9/1936 | Bucigalupo | 52/167 |
| 3,789,174 | 1/1974 | Barkan | 52/167 |
| 4,102,097 | 7/1978 | Zolotay | 52/167 |
| 4,179,104 | 12/1979 | Skinner | 52/167 |

FOREIGN PATENT DOCUMENTS

| | | | |
|---|---|---|---|
| 744876 | 2/1944 | Fed. Rep. of Germany | 188/379 |
| 2336521 | 6/1975 | Fed. Rep. of Germany | 248/581 |
| 1321831 | 7/1963 | United Kingdom | 52/167 |
| 545737 | 3/1977 | U.S.S.R. | 52/167 |
| 557221 | 5/1977 | U.S.S.R. | 188/379 |
| 696115 | 11/1979 | U.S.S.R. | 52/167 |
| 765461 | 9/1980 | U.S.S.R. | 52/167 |
| 781263 | 11/1980 | U.S.S.R. | 52/167 |
| 783413 | 11/1980 | U.S.S.R. | 52/167 |

*Primary Examiner*—Henry E. Raduazo

*Attorney, Agent, or Firm*—Cushman, Darby & Cushman

[57] ABSTRACT

A base isolation system for a structure for protecting against earthquakes. The superstructure is supported on a first and second discs, one above the other. Between the discs, and between the lower disc and the foundation there are elastomeric or similar support means which provide restoring forces if the structure is displaced by oscillations of the ground. Means are provided so that one set of elastomeric or similar support means is subjected only to horizontal oscillations. The other support means is subjected to vertical oscillations and, if desired, rotations, but not horizontal oscillations. Connecting means also may be provided to allow slow vertical displacements of the second support means but to prevent rapid vertical displacements until a predetermined vertical force is supplied. These means disconnect if rapid oscillations occur with strong forces; when these means disconnect, the structure can oscillate through greater vertical displacements, by means of the elastomeric support means. Connecting means also may be provided to prevent relative horizontal translations between the discs (or between the disc and the foundation) which are connected by the said first set of elastomeric support means.

25 Claims, 15 Drawing Figures

Fig. 7.
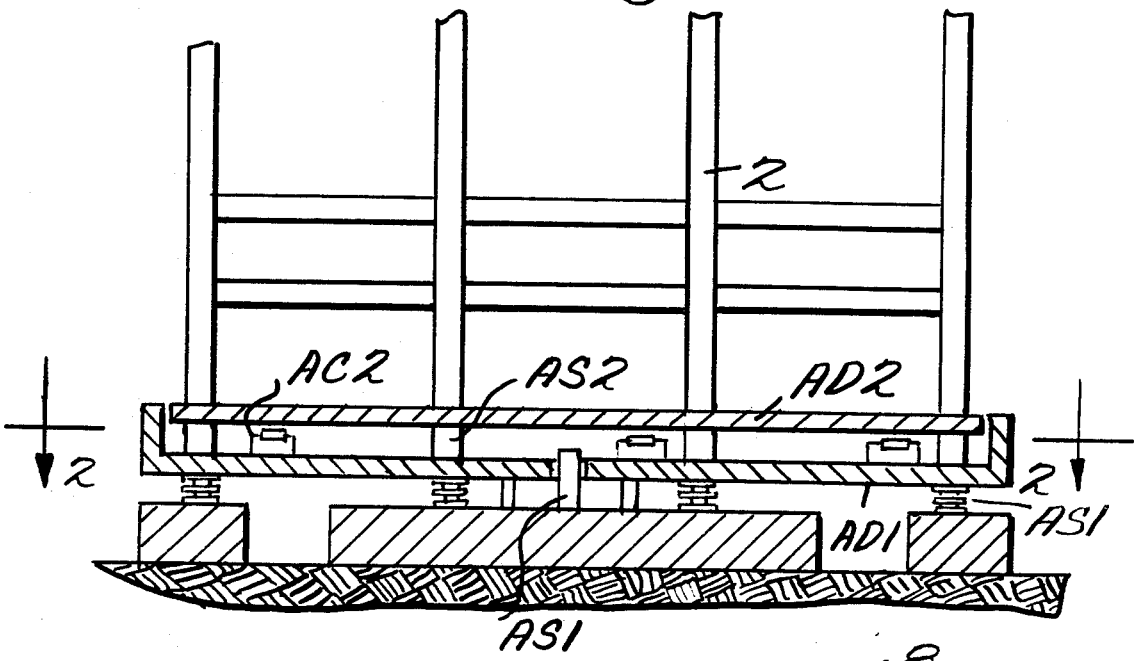
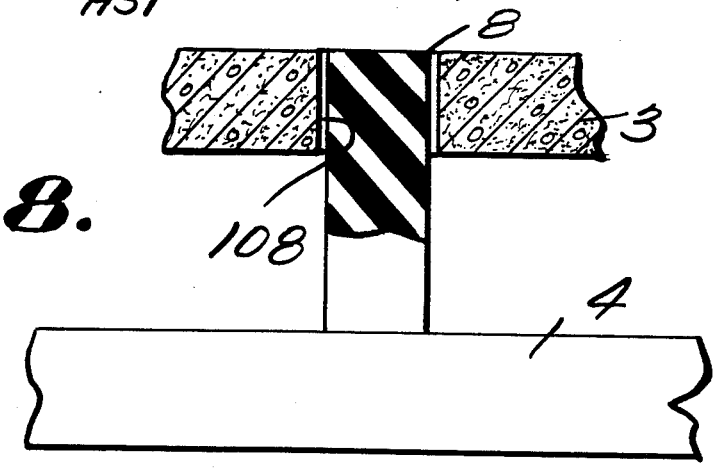
Fig. 8.
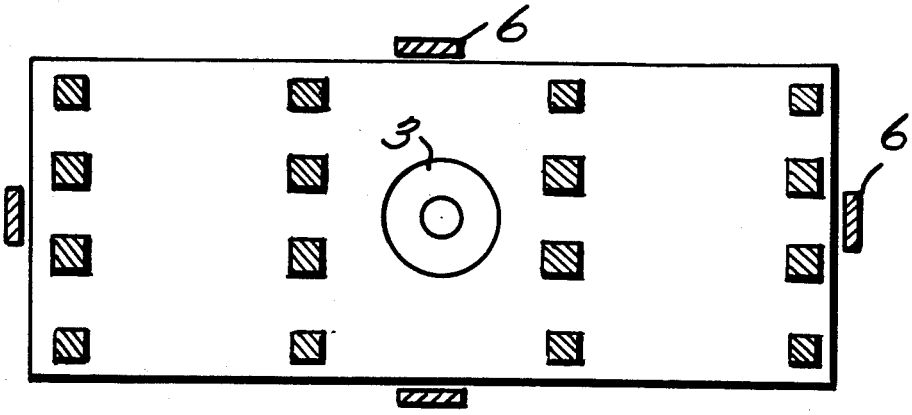
Fig. 2.

Fig. 11.
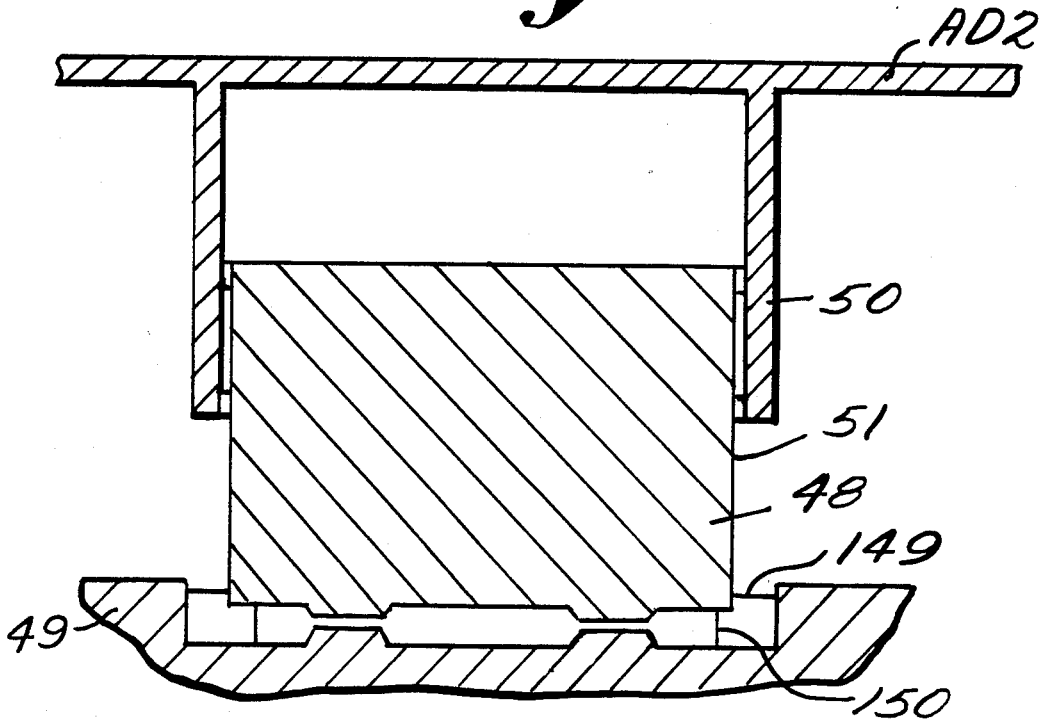
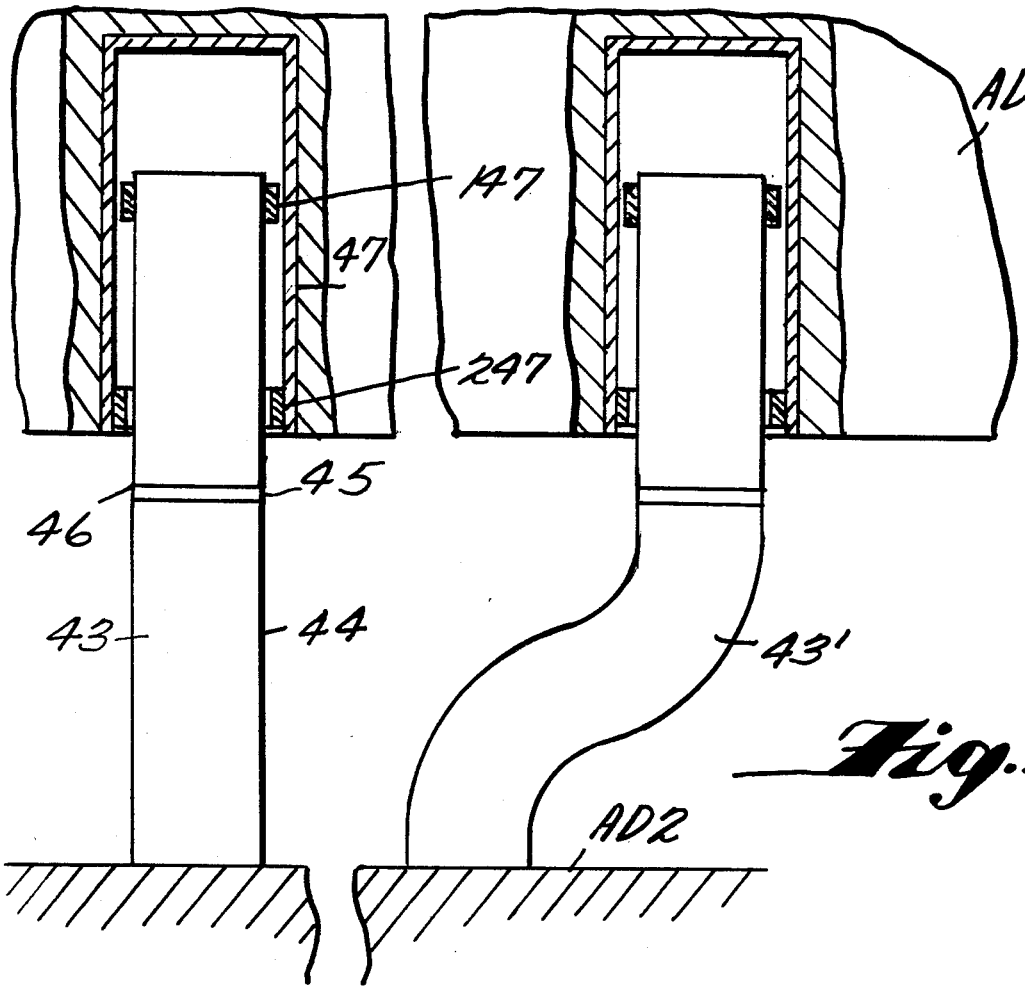
Fig. 12.

EARTHQUAKE GUARDING SYSTEM

This is a continuation of my application Ser. No. 231,754 filed Feb. 5, 1981, which in turn is a continuation-in-part of my prior U.S. application Ser. No. 201,803 filed Oct. 29, 1980 both now abandoned.

The present invention relates to a system for protecting a construction from the destructive oscillations of a great earthquake or of an explosion, etc. It utilizes the principles of my U.S. Pat. No. 4,166,344. The present invention provides an improvement by introducing a mechanism for protecting the construction from vertical oscillations in addition to horizontal oscillations so as to provide a three dimensional isolation system.

BACKGROUND OF THE INVENTION

The oscillation which is made by a point of the earth, because of an earthquake, occurs in three dimensions and is different for each earthquake. In other words, this oscillation is expressed in a three—dimensional coordinate system OXYZ comprised of three components, i.e., the oscillation consists of components along the three axes OX, OY and OZ. With the axis OZ positioned vertically, the component of the oscillation of the earthquake along this axis is called the vertical component and the components along the OX and OY axes are called horizontal components. Seismometers, the instruments which record earthquake movements, record all three of these components. However, the relative importance of the respective components is not equal in relationship to the safety of structures. It has been generally accepted that the vertical component usually is less important than the horizontal components, because the capacity of the structure to transfer vertical loads is generally far greater than for horizontal loads. This is because they are shaped in a way suitable for transferring of the vertical loads of the structure and because the capacity of the ground is generally far greater for vertical forces than for horizontal forces. In addition, it has been presumed that the possibility of a vertical component OZ of the seismic accelerations greater than 1.0 g is very small because it has been presupposed that the soil and the surface which supports the structure is generally not capable of transferring tension forces.

Because of these factors, the science of earthquake engineering has directed its attention primarily to the horizontal components and has given only secondary consideration to vertical components. However, in the earthquake which occurred in Imperial Valley, Calf., United States, in 1979 one accelerometer (Station 6) recorded a vertical component of 1.74 g. The reason for this occurrence is not yet adequately understood. However, that particular station was located within a few kilometers of the fault, and in fact was between two faults which were disturbed during the eqrthquake. It is possible that the earth was horizontally compressed at that location by simultaneous disturbances along both faults, causing a great vertical acceleration. Nevertheless, this occurrence makes it clear that vertical components of earthquakes will require further consideration, and that isolation of structures from all the components, both horizontal and vertical, will be desirable at least in some cases. The cases in which such isolation may be necessary will be known better when it becomes more clear what conditions cause vertical accelerations of significant magnitude.

In my U.S. Pat. No. 4,166,344, I described a system for isolating a structure from the earth when horizontal seismic accelerations exceeded a predetermined value. The system includes a disc or load distributing base, usually of reinforced concrete, supports which carry the weight or vertical load of the structure and which also impose elastic restoring forces on the structure which react against horizontal movement, and connecting means which prevent horizontal movement of the construction under normal circumstances, for example, when the building is subjected to forces from winds. The connecting means are designed to disconnect when the structure is subjected to horizontal forces greater than a predetermined value.

Until new structural materials are invented, with properties which are adequately different from the properties of existing materials, something which cannot be foreseen, it is also absolutely necessary to avoid certain structural elements in order to avoid instability of the structure. The elements to be avoided are those which transfer great axial loads in a first direction and which are simultaneously required to follow great deformations in a second direction which is perpendicular to the first one. For this reason, it is necessary to provide separate elements for the vertical and horizontal isolation.

SUMMARY OF THE INVENTION

The principal object of the present invention is to provide a support system for both horizontal and vertical isolation of structures. In particular, the invention provides a system for vertical isolation in combination with the horizontal isolation system of U.S. Pat. No. 4,166,344. The vertical isolation system which is part of the present invention, however, may also be used independently from the means for the horizontal isolation or with some other horizontal isolation system.

An important feature of the present invention is the separation of components which provide vertical and horizontal isolation. Thus, unlike the system of my previous patent in which there was one earthquake guarding disc or load distributing base, there are two load distributing bases or discs. Between these discs, which are positioned one above the other, there are isolation means, and additional isolation means are positioned between the lower disc and the foundation. One isolation means isolates vertical forces and the other isolates horizontal forces. This separation of isolation means is important to avoid instability of the components and of the whole structure.

For the sake of convenience, the earthquake guarding system of U.S. Pat. No. 4,166,134, which previously has been known as Alexisismo, will be called Alexisismo No. 1, to distinguish it from the three dimensional isolation system of the present invention. The vertical isolation system of the present invention will be referred to as Alexisismo No. 2. The system of the present invention which will be discribed contains both Alexisismo No. 1 and Alexisismo No. 2. However, as mentioned previously, Alexisismo No. 2 may be used independently or with some other system of horizontal isolation.

Alexisismo No. 1 can be characterized as containing the following elements:

(a) Alexisismo Support Means No. 1 (AS1)
(b) Alexisismo Connecting Means No. 1 (AC1)
(c) Alexisismo Disc or Discs No. 1 (AD1).

To provide three dimensional isolation, the present invention includes three supplementary elements, which will be designated as follows:

(a) Alexisismo Support Means No. 2 (AS2)
(b) Alexisismo Connecting Means No. 2 (AC2)
(c) Alexisismo Disc or Discs No. 2 (AD2).

It will be understood that, in some circumstances, the coordinates OX and OY and the coordinate OZ may not be horizontal and vertical respectively, but that they will be perpendicular to each other in any case. However, for the sake of simplicity, the words "vertical" and "horizontal" will be used. The same principle may be applied to structures for which the reactions of the supports is inclined with respect to vertical.

DETAILED DESCRIPTION OF COMPONENTS

Alexisismo Supports

The AS1 are the same as the elastic support means of Alexisismo No. 1 which were described in the abovementioned patent. The disclosure of said patent is incorporated herein by reference.

The AS2 are structural elements comprising elastic support means which transfer the vertical loads from the superstructure to the foundation, being positioned between AD2 and the foundation (the earth) or between the AD1 and AD2. The location and number of support elements which collectively make up AS2 is subject to the discretion of the designer of the structure. However, it is preferred that those elements are located at the points of concentrations of vertical loads, e.g., beneath columns. The elements which comprise AS2 must be capable of safely transferring the vertical loads of the structure. They must have sufficient flexibility in the vertical direction to ensure a period of vertical oscillation of the structure which is ample to adequately isolate the structure from vertical seismic movements of the ground.

As will be apparent from the description which follows, means are provided to prevent imposition of significant eccentricity on AS2. These means comprise elements which limit relative horizontal movements between the components connected by AS2, i.e., between AD2 and the foundation or between AD2 and AD1; these means do not restrict vertical relative movements between the components connected by AS2. This feature assures that AS2 are not subjected to horzontal deformations which could make the structure unstable. The elements which provide this protection may be vertical columns extending upwardly from the foundation and enclosing AD2 or columns extending vertically from AD1 and enclosing AD2. Other arrangements will readily suggest themselves. Of course, such columns or the like must allow small movements such as arise from thermal expansion and contraction. On the other hand, these elements must be strong enough to withstand the horizontal forces which arise in the isolated structure during an earthquake. Depending on their design, these components may also prevent rotations between AD2 and the foundation or between AD1 and AD2 or they may permit rotations, depending on the requirements of the structure. Similarly, means are provided to substantially prevent vertical displacements between the components joined by AS1.

The exact design of AS2 will be the result of evaluation of the expected performance of the whole structure during an earthquake, using the principles of dynamic structural analysis. The AS2 must be very flexible and resilient vertically. Consequently, the displacements of the superstructure relative to the ground, because of vertical oscillations, may be great and may not be acceptable during the normal life of the structure, i.e., except during great earthquakes. Therefore, the installation of AC2 may be required to prevent such displacements at times other than during a great earthquake. However, in cases where such displacements can be accepted, AC2 may be omitted.

Alexisismo Connections

The AC1 are of the same type as the connecting means of Alexisismo No. 1, and will not be described in detail here. The disclosure of the aforesaid patent is incorporated herein by reference for this purpose.

The AC2 are structural components which are positioned between the same elements as AS2, i.e., between AD2 and AD1 or between AD2 and the foundation. These AC2 are designed to provide resistance to relative vertical movements between AD1 and AD2, or between AD2 and the foundation, in proportion to the velocity of such movements. Consequently, AC2 provide little or no resistance to slow movements, but provide substantial resistance against rapid movements. The AC2 which are illustrated and described herein comprise a cylinder containing a piston and fluid (usually a liquid) so that the piston divides the cylinder into two vertically-spaced chambers. The piston is connected through a rod to e.g., AD2, and the cylinder is connected to e.g, the foundation. There is a small tube around the cylinder or an opening through the piston to allow transfer of only a small amount of liquid. Consequently, in the case of rapid movements, which allow transfer of only a limited amount of fluid through the tube or opening, the fluid provides resistance. On the other hand, in the case of slow movements, the fluid provides almost no resistance.

Disconnecting elements are included so that the fluid elements are only operational during normal circumstances. Thus, for example, the connections between the cylinder and the foundation may include a rod which breaks when it is subjected to a force of predetermined magnitude. The arrangement is such that during slow movements, the fluid cylinder provides little resistance so that little, if any, force is imposed on the breakable element. On the other hand, if there are rapid vertical movements e.g., during an earthquake, the fluid will provide resistance and stresses will be imposed on the breakable element. If these stresses become greater than the strength of the breakable element, for example in the case of the great earthquake, it will break, and the connection through AC2 will disconnect. The only connection which remains between AD1 and AD2 or between AD2 and the foundation, after those elements break, will be through AS2. The flexibility of AS2 will then allow oscillation in a vertical direction, and, if desired, rotations with an appropriate period so that the structure will not be damaged. Steps may be provided to limit vertical oscillations to predetermined displacements to prevent damage to AS2 if the structure's vertical oscillations would otherwise damage AS2.

The numbers and positions of the AC2 will be determined at the discretion of the designer of the structure. AC2 will be arranged in such a way as to substantially prevent rapid ralative vertical movements between the superstructure and the foundation during wind and small earth tremors. They allow slow vertical movements, and they disconnect in case of strong earthquakes.

Alexisismo Disc or Discs

AD2 is similar to AD1 and typically is constructed of reinforced concrete or steel. Its strength and structure is subject to the discretion of the designer.

BRIEF DESCRIPTION OF FIGURES OF DRAWINGS

In the drawings:

FIG. 2 is a horizontal cross-section along lines 2–2 of FIG. 1;

FIG. 7 is a vertical cross-section in schematic form through another embodiment of the present invention;

FIG. 8 is a view in elevation, partially in cross-section, showing a component of AS1;

FIG. 11 is a cross-section along lines 11—11 of FIG. 10;

Figure 13:
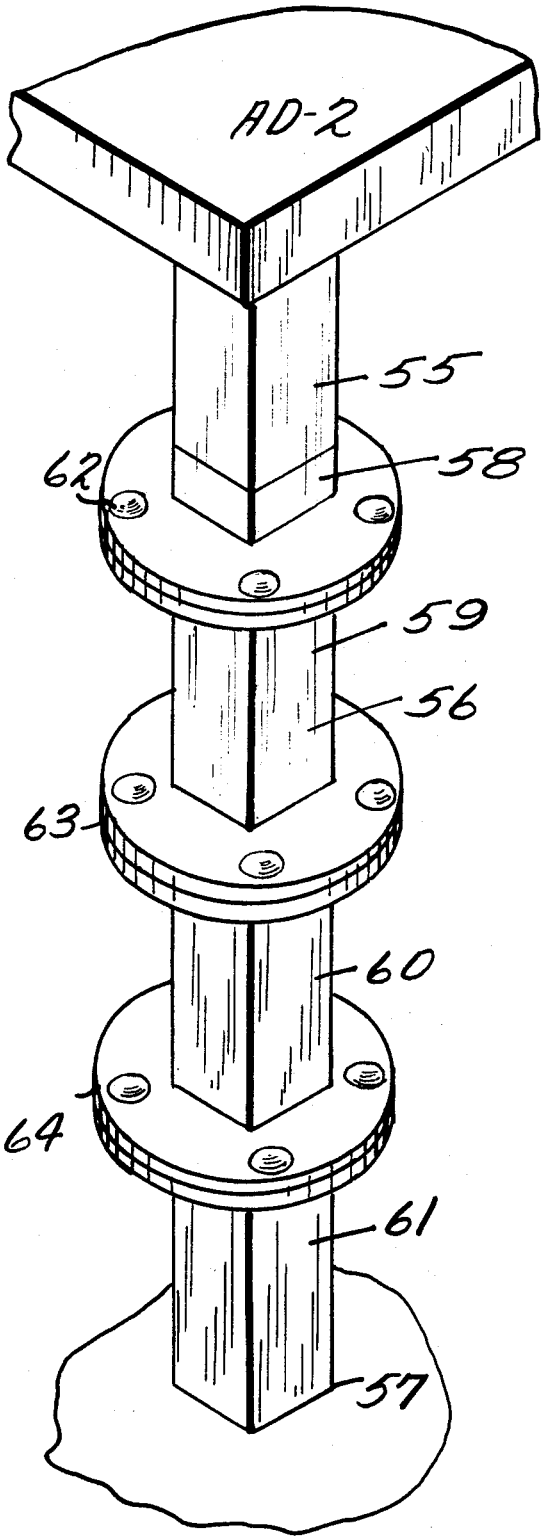
Figure 14:
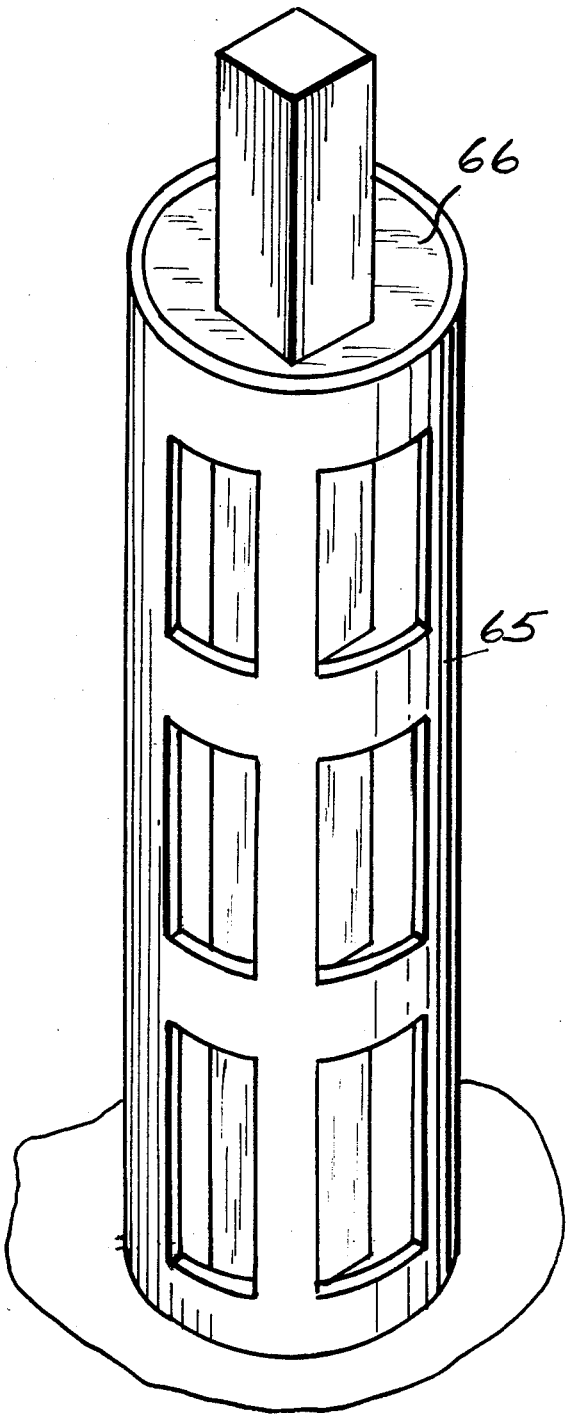

FIG. 12 ia an enlarged elevation view, partly in cross-section, of a form of AS1, similar to FIG. 8;

FIG. 13 and FIG. 14 are perspective views of another form of AS2; and

Figure 15:
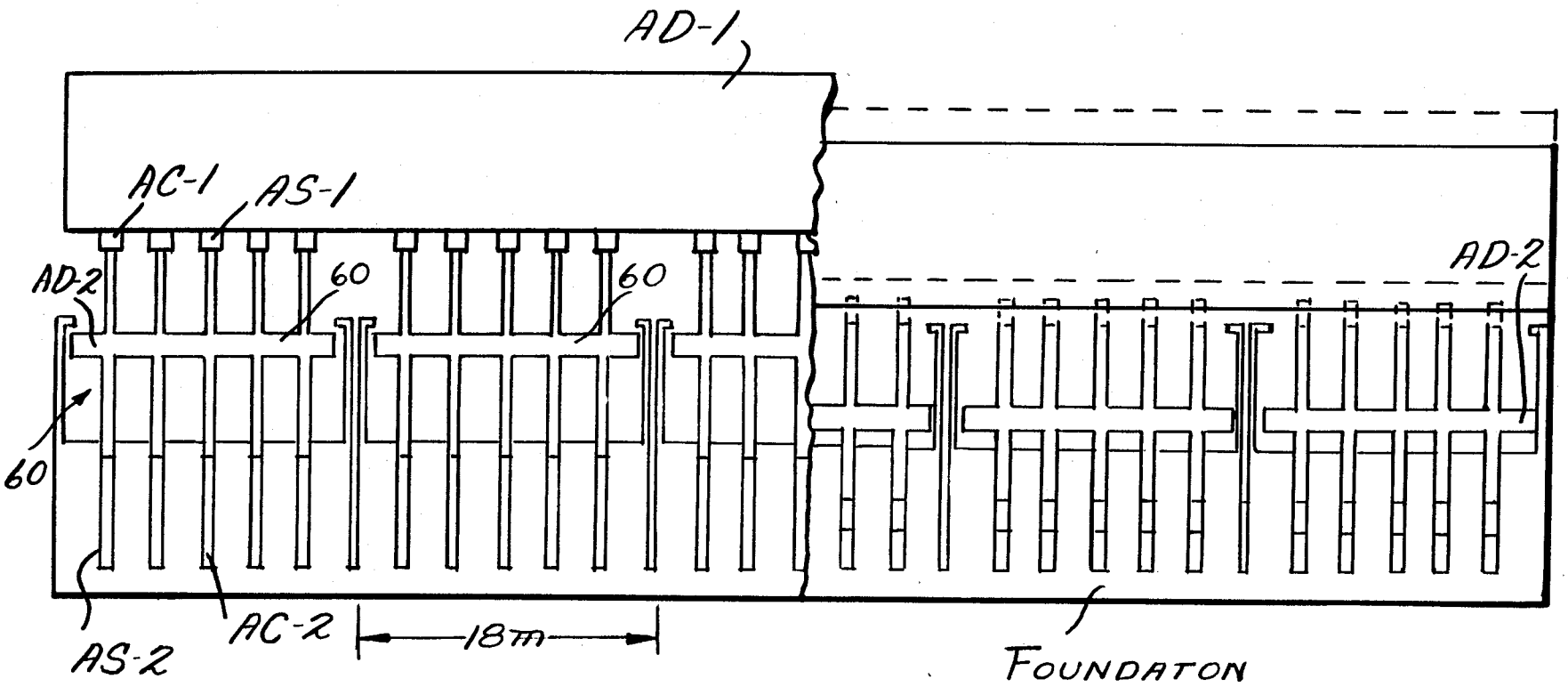

FIG. 15 is a vertical cross-section of another embodiment of the system.

Figure 1:
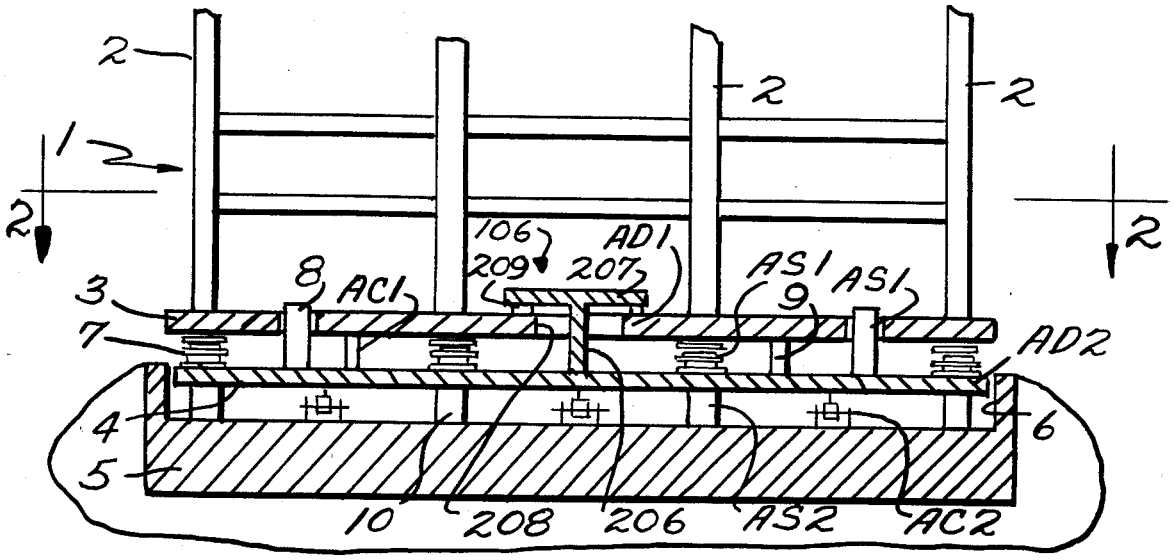
FIG. 1 is a vertical cross-section, in schematic form, showing one embodiment of the invention.

FIG. 1 illustrates a structure which includes a superstructure 1 including columns 2. The columns are supported on a concrete or steel platform 3 which comprises Alexisismo Disc No. 1. Below this structure there is a horizontal concrete or steel platform 4 which constitutes Alexisismo Disc No. 2, and, below platform 4, there is a foundation 5. In order to substantially prevent shearing movement of AS2 means are provided to limit horizontal movement of the platform 4 (AD2); columns 6 extending upwardly from the foundation perform this function and are spaced from platform 4 by a small clearance to allow for thermal expansion. The same columns 6 can be used for vertical stops to limit the vertical movement between AD2 and the foundation. Similarly a stop 106 is provided to limit vertical movement between AD1 and AD2. The stop consists of a vertical post 206 and a step 207 extending horizontally from the top of post 206. Post 206 extends up from AD2 through an opening 208 in AD1. The opening 208 must be large enough to allow for horizontal oscillations anticipated during an earthquake. A plastic layer 209 e.g. polytetrafluoroethylene may be used between stop 207 and AD1.

Figure 3:
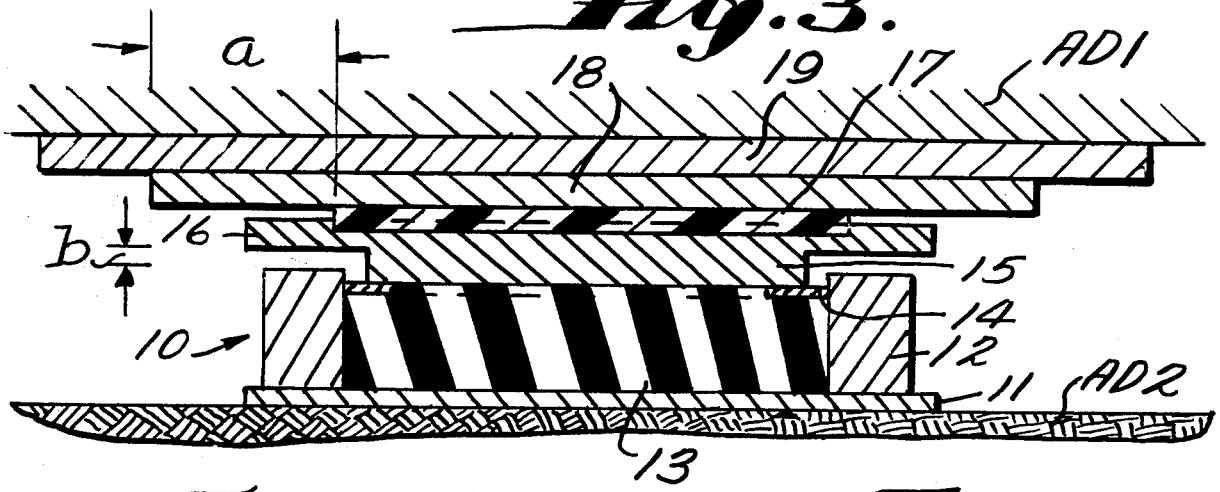
FIG. 3 is a cross-section through a pot bearing used as a component in one kind of AS1, useful with the invention.

Between platforms 3 and 4 (AD1 and AD2) there are provided the components of Alexisismo No. 1, namely AS1 and AC1. These are illustrated only schematically. In particular, AS1 is provided, e.g., by pot bearings 7, which are equipped with a friction-free sliding surface, for example of polytetrafluoroethylene plastic which slides against a stainless steel surface, and by rubber columns 8. Suitable bearings are illustrated in FIG. 3. A suitable type of rubber column is shown in FIG. 8 and will be described below. AC1 is illustrated schematically at 9. It may be of the type described in U.S. patent application Ser. No. 46,760, filed June 8, 1979. The disclosure of that application is incorporated herein by reference.

As shown in FIG. 3, bearing 7 may be a pot bearing. Such a bearing comprises a steel base 11 and a cylinder 12 extending upwardly from the steel base. Within the cylinder there is a neoprene rubber mass 13. There is a closure ring 14 and a piston 15, above the neoprene mass, which seal the chamber which contains the neoprene mass 13. The piston 15 includes a lateral flange 16 at its top which extends laterally over the cylinder 12, but is spaced vertically from the cylinder by a clearance b. This clearance allows limited rotation. The top of the piston 16 has a recess which encloses a polytetrafluoroethylene pad 17 which extends above the top of the piston. Above this pad, there ia a stainless steel plate 18 which slides on the polytetrafluoroethylene pad. The stanless steel plate must be sufficiently larger than the polytetrafluoroethylene pad to allow for whatever horizontal displacement is required. Such displacements may be rather large. The stainless steel plate 18 is welded to steel plate 19 which is in turn bolted or otherwise secured to the concrete above it.

Figure 9:
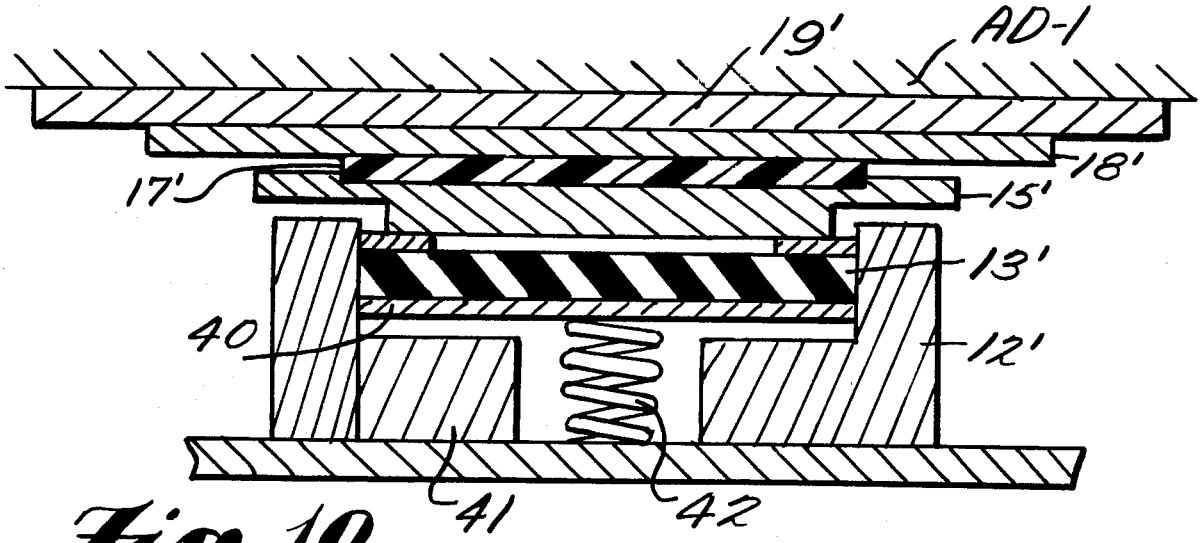
FIG. 9 illustrates another embodiment of AS1.

Another embodiment of pot bearing, especially adapted to the base isolation system of Alexissismo No. 1, is illustrated in FIG. 9. For convenience, parts corresponding to the embodiment of FIG. 3 are indicated with a prime designation. Thus the elastomer disc 13′ is enclosed in a cylinder 12′ beneath a piston 15′. Above the piston 15′ there is a polytetrafluoroethylene pad 17′, a stainless steel disc 18′ and a steel plate 19′. Beneath the elastomer disc 13′ there is a metal plate 40 of the same cross-section as the interior of the cylinder and there is a ring 41 welded to or integral with the interior of cylinder 12′, so that, in its lowest position, plate 40 is supported on ring 41. In case of vertical oscillations which increases the distance between a portion of AD1 and the earth under that part of the structure, the bearing of FIG. 9 provides means to assure the integrity of the bearing; there is a compression spring 42 within cylinder 41 which lifts plate 40. The spring 42 will not support the weight of the structure, but it will lift the elastomer pad if the distance between AD1 and the earth increases because of overturning moments. Consequently, the spring assures that the components 17′ and 18′ do not become separated from each other.

FIG. 8 illustrates another component of AS1 which can be used with the pot bearing illustrated in FIG. 3. It is a round rubber column 8, anchored at its base to AD2 (or the foundation). There is a hole 108 through AD1 which is large enough to receive the rubber column, and the hole may be lined with a steel tube. During horizontal movements between AD1 and AD2, or between AD1 and the foundation, the upper part of the rubber column 8 is displaced laterally, and it applies horizontal restoring forces to the structure, the magnitude of which increases with the displacement. The dimensions of column 8 depends on the characteristics of the rubber used. These dimensions will be determined by evaluation of the expected performance of the whole structure during an earthquake, using the principles of dynamic structural analysis.

A more sophisticated form of the rubber column 8 is illustrated in FIG. 12. In this figure, there are shown, at the left, a column 43 in its normal position, and, at the right, a column 43' when AD1 has been displaced laterally relative to AD2. In each case, the column comprises a vertical rubber cylinder 44 and a steel cylinder 45 extending vertically from the top of the rubber cylinder. The two cylinders are bonded together at 46.

A steel tube 47 is embedded in a vertical position in the disc AD1, with its lower end open to receive the steel cylinder 45, the steel tube 47 being a larger internal diameter than the cylinder 45. The steel tube 47 and the steel cylinder 45 must be of sufficient length that the cylinder is not drawn out of the tube when AD1 is displaced horizontally, relative to AD2. These lengths can be calculated by an engineer with knowledge of the maximum horizontal displacements for which the structure is designed. As shown in FIG. 12 there are two rings of friction reducing plastic such as polytetrafluoroethylene, around steel cylinder 45 and vertically spaced from each other. The upper ring 147 is bonded to steel cylinder 45 and the lower ring 247 is bonded to steel tube 47. In each case, the ring is not as wide as the space between cylinder 45 and tube 47.

Figure 4:
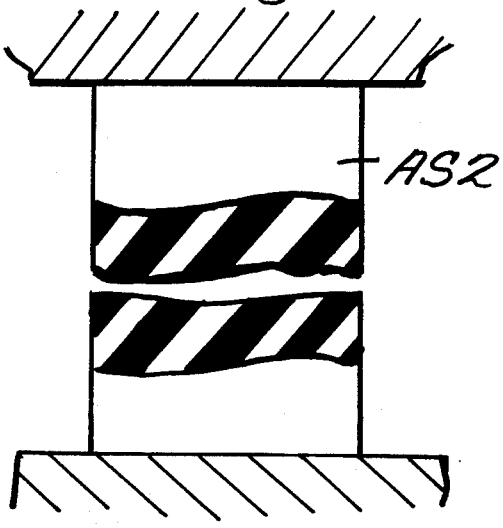
FIG. 4 is a cross-section through a kind of AS2.
Figure 5:
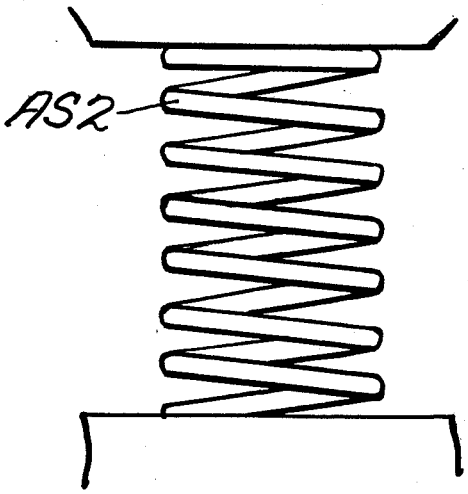
FIG. 5 is a cross-section through another kind of AS2.

AS2 may comprise a round column of rubber, as shown in FIG. 4, which allows substantial vertical movements or a steel spring as shown in FIG. 5 or steel laminated rubber bearings, etc. The modulus of elasticity and size and shape of AS2 are selected to give sufficiently great fundamental period for the vertical oscillation of the structure. These characteristics may be calculated according to the principles of dynamic analysis.

FIGS. 13 and 14 illustrate a different form of AS2. FIG. 13 illustrates the rubber column and FIG. 14 shows how that column is enclosed in a tube. As seen in FIG. 13, there is a steel post 55 extending downwardly from AD2, and a rubber column 56 of the same cross-section as the post extending downwardly from the post to the foundation of AD1 at 57. The rubber column may be bonded to the post. The rubber column is divided into four parts 58, 59, 60 and 61 which are separated by plates 62, 63 and 64. The parts of the rubber column are bonded to these plates. For convenience, two plates may be used bolted together as shown to facilitate replacement of part of the rubber column. The entire assembly is enclosed in a tube 65, of the same shape as plates 62, 63 and 64, with the steel post 55 extending upwardly above the top 66 of the tube to AD2. There must be sufficient distance between top 66 and AD2 that they do not come in contact during anticipated vertical oscillations of the structure. There is a clearance between the rubber column and the interior of the tube 65, but the plates 62, 63 and 64 slide against the inner wall of tube 65. Consequently tube 65 controls buckling of the rubber column. The plates 62, 63 and 64 increase the stiffness of the rubber column to some extent, but also assist in controlling buckling.

Figure 6:
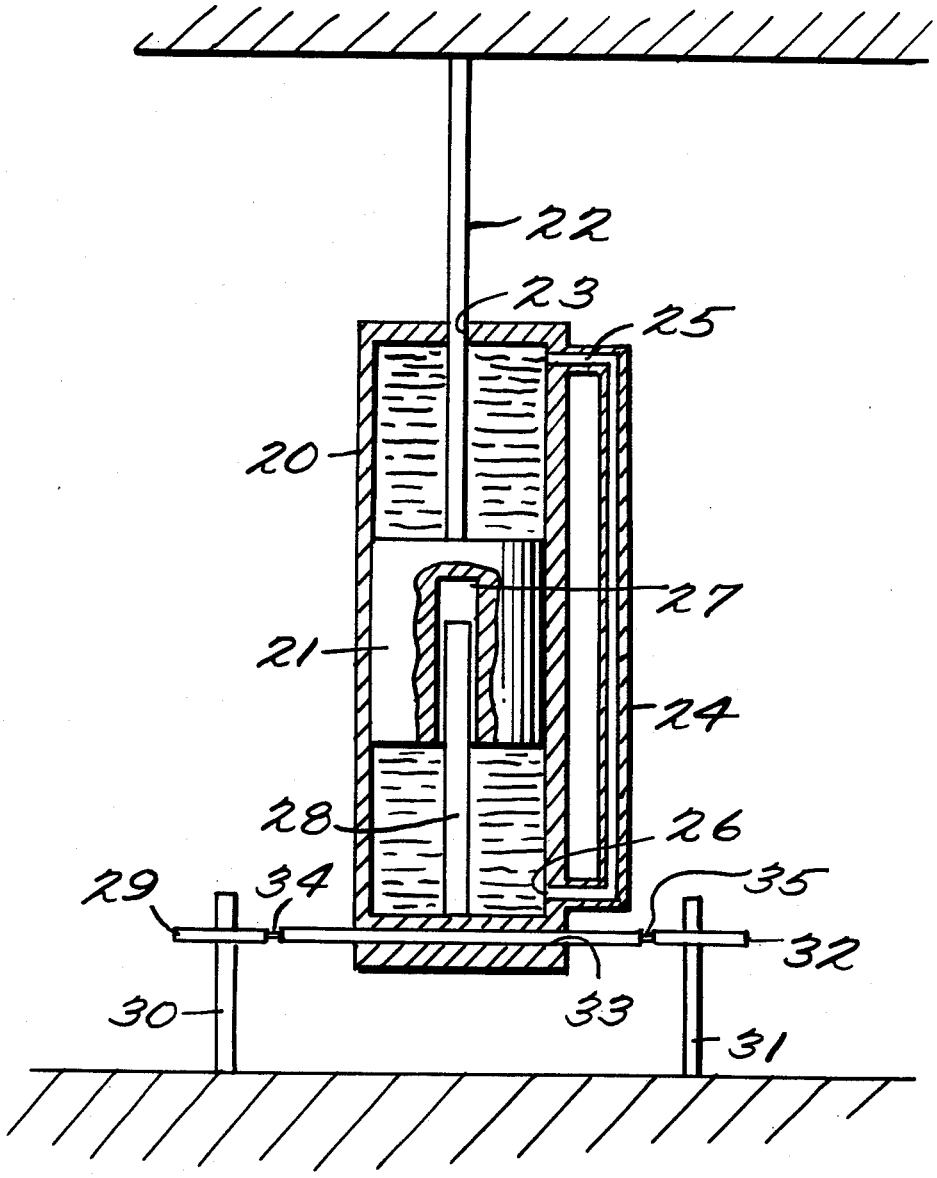
FIG. 6 is a cross-section through a preferred form of AC2.

A preferred kind of AC2 is shown in FIG. 6. The structure is in part similar to a conventional shock absorber and it comprises a fluid filled cylinder 20 containing a piston 21. The piston is provided with a piston rod 22 which extends upwardly through an opening 23 through the top of the cylinder and which is connected to the concrete platform above the cylinder. There is a small diameter pipe 24 which extends vertically alongside the cylinder 20 and which connects through upper and lower openings 25 and 26 into the upper and lower parts of the cylinder 20. Thus, as the piston moves up or down, fluid is forced through the pipe 24. During slow movements, such as the downward movement of the discs during construction or because of creeping of AS2 or slow vertical movements induced by a small earth tremor, the pipe provides little or no resistance to the flow of liquid, and thus AC2 provideds little or no resistance to vertical movements. On the other hand, the pipe provides substantial resistance to rapid flow of liquid, so that AC2 provides substantial resistance to vertical movements which may occur during a strong earthquake.

The piston 21 has a vertical opening 27 in its bottom and there is a rod 28 extending upwardly from the bottom of cylinder 20 which is slidably positioned in said opening 27, with an appropriate hermetic seal. The rod 28 provides for equalization of fluid volume because of piston rod displacement during movement of the piston. Other known mechanisms to provide such equalization may be used.

There is a breakable element below cylinder 20 which is indicated generally at 29 and which connects the AC2 to the foundation or the disk. This element consists of two posts 30 and 31, which support a breakable bar 32. The bar 32 extends slidably through a drilled hole 33 which extends across the lower part of cylinder 20. Notches 34 and 35 are cut into bar 32 which will break when a shearing force of predetermined magnitude is applied to the bar. Such a force will be applied when rapid vertical oscillations are applied to the structure and the fluid in cylinder 20 provides substantial resistance. The strength required for bar 32 can be calculated from knowledge of the vertical forces which the designer intends the superstructure to withstand without substantial vertical oscillation relative to the ground. After an earthquake, bar 32 can be replaced.

Figure 10:
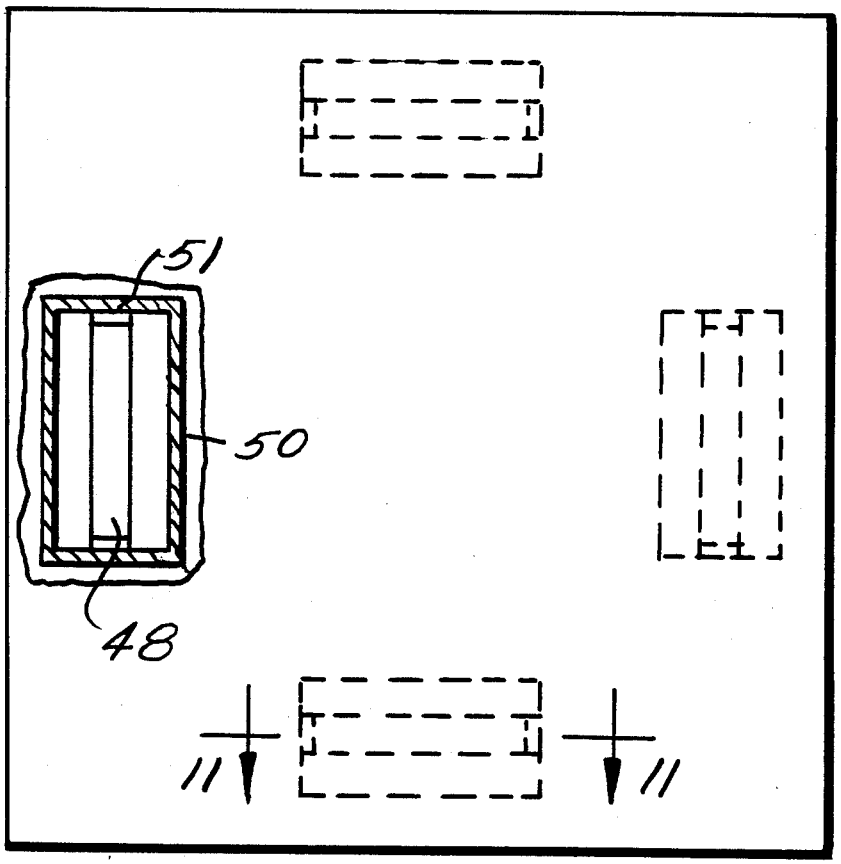
FIG. 10 is a plan view of AD2 which illustrates another embodiment of columns which limit relative horizontal movement and rotations between AD2 and AD1 the foundation.

In place of the columns 6, which limit horizontal displacement but permits rotation between the components connected by AS2, one may use the devices illustrated in FIGS. 10–11 which limit both horizontal displacement and rotation between those components.

As seen in FIG. 11, each device consists of a vertical plate 48 supported on the foundation or AD1 at 49. The plate slides in a rectangular tube 50 which extends downwardly from AD2. Between the sides of plate 48 and the tube, there are friction reducing plastic pads 51 which reduce friction between the plate 48 and the tube 50. This attachment is similar to rings 147 and 247 as described above. As seen in FIG. 10, each plate 48 slides at its ends along one pair of sides of the rectangular tube 50. Therefore, horizontal displacement is prevented in a first direction. On the othere hand, displacements in a second direction is allowed, as the place 48 is not as wide as tube 50 in the second direction.

Four tubes and plates are used, in sets of two which are perpendicular to each other. The two sets therefore prevent all horizontal movements. In addition, they prevent substantial rotations. These components however allow for thermal expansion and contraction of AD2, perpendicularly to plates 48; they are positioned so that all directions of such thermal movements are allowed. The plates can be supported by bars in tension (150) and shear (149) which break in case the moments and the shear forces become greater than a predetermined level.

FIG. 7 illustrates an alternate embodiment in which the superstructure is anchored to AD2 and AD1 is between AD2 and the foundation. In this case, vertical columns are connected to AD1 and extend upwardly and around AD2. Also, as illustrated in FIG. 7, the foundation is composed of several separate parts, an arrangement which also is permitted for the embodiment of FIG. 1.

FIG. 15 illustrates an embodiment useful for very large structures in which Ad2 is divided into several segments 60, for example 18 meters square, each of which supports a portion of AD1. In FIG. 15, at the left the structure is shown with AD2 elevated, and at the right it is shown with AD2 lowered, to demonstrate how the structure will move vertically. However, because AD2 is divided into five parts, it can cope with the fact that in every instant portions of the ground under the structure will be at different levels than other portions, because of the seismic waves.

In this design AD2 includes many vertical columns or posts extending upwardly and downwardly for perhaps 1.5 meters. There are holes in the foundation to receive the posts AS2 and AC2, and therefore prevent buckling of AS1.

It will be understood that the system can be modified in details of construction and mode of operation without departing from the invention, as defined below.

What is claimed is:

1. A structure having a superstructure and isolation means for isolating said superstructure from the ground during an earthquake or other strong oscillations of the ground, said isolation means comprising:

a first load distributing base;

a second load distributing base substantially parallel to said first load distributing base;

one of said load distributing bases supporting said superstructure and the other of said load distributing bases being between said one load distributing base and the ground;

first elastic means;

second elastic means;

said first elastic means connecting said one load distributing base and said other load distributing base and said second elastic means connecting said other load distributing base and the ground;

means substantially preventing shearing movement between the components connected by one of said elastic means without preventing rotational movements, between said components, which are substantially only around a horizontal axis and translational movements, between said components, which are substantially perpendicular to said load distributing bases, the said structure being constructed and arranged so as to allow, between the components connected by said other elastic means, only translational movements substantially parallel to said load distributing bases and rotational movements around a vertical axis, whereby the respective elastic means provide isolation.

2. A structure as set forth in claim 1 including means substantially preventing movements between the components connected by said other elastic means in said direction perpendicular to said load distributing bases.

3. A structure as set forth in claim 1 in which said means substantially preventing shearing movement comprises columns extending in said perpendicular direction.

4. A structure as set forth in claim 3 in which said columns are positioned outwardly from one of said load distributing bases by a small clearance to allow for thermal expansion.

5. A structure as set forth in claim 1 including means preventing rotation between the components connected by said one elastic means.

6. A structure as set forth in claim 5 in which said rotation preventing means comprises a plate having edges and surfaces, means securing said plate to one of said components connected by said one elastic means, a rectangular tube having longer sides and shorter sides, means connecting said tube to the other of said components connected by said one elastic means, said plate being received in said rectangular tube with the edges of the plate slidable against the shorter sides of said rectangular tube and the surfaces of said plate being spaced from the longer sides of said rectangular tube, whereby said components connected by said one elastic means can move towards and away from each other, but are substantially prevented from relative translational motion parallel to each other, along said plate, and rotational motion about an axis perpendicular to said plate, the space between the surfaces of said plate and the longer sides of said rectangular tube permitting thermal expansion and contraction of said load distributing bases in a direction perpendicular to said plate.

7. A structure as set forth in claim 6 in which there are at least two of said plates and tubes, with the plates and tubes perpendicular to each other, said plates and tubes being positioned so that thermal expansion and contraction is allowed in all directions but rotational motion and relative translational motion parallel to the load distributing bases is substantially prevented in all directions.

8. A structure as set forth in claim 1 in which said one elastic means includes an elongated rubber column, an elongated hollow cylinder receiving said elongated rubber column, said rubber column being connected to one of the components connected by said one elastic means and said cylinder being connected to the other of the components connected by said one elastic means.

9. A structure as set forth in claim 1 including connecting means, connected to the components which are connected by said one elastic means, said connecting means providing resistance to movements between said components in translation perpendicular to said load distributing bases and rotation about horizontal axes, said resistance being proportional to the velocity of said movements, said connecting means being constructed and arranged to disconnect when said resistance is greater than a predetermined force, whereby, upon imposition of strong accelerations on the structure, the connecting means disconnects and the structure is supported thereafter by said one elastic support means.

10. A structure as set forth in claim 9 wherein said connecting means comprises a cylinder a piston slidable along said cylinder fluid connecting means for transfer of fluid between spaces at the opposite sides of said piston to permit transfer of fluid between said spaces when movement of said piston displaces said fluid, a piston rod connected to said piston and to one of said components which are connected by said one elastic means, means for connecting said cylinder to the other of said components which are connected by said one elastic means, said connecting means including coupling means for disconnecting said cylinder from said other component when subjected to a predetermined force.

11. A structure as set forth in claim 10 in which said fluid connecting means is a small diameter pipe whose diameter is smaller than the diameter of said cylinder.

12. A structure as set forth in claim 10 wherein said coupling means is a rod extending though a wall of said cylinder, said rod having a notch whereat said rod will break upon application of said predetermined force.

13. A structure as set forth in claim 1 wherein said other elastic means includes a cylinder which has an opening at one end a piston slidable through said opening and along said cylinder and having a free end, an elastomeric mass within said cylinder, a support member extending inwardly from the interior wall of said cylinder, between its ends, to support said elastomeric mass when it is compressed by said piston and spring means extending through said support member to urge said elastomeric mass against the other end of said piston, whereby the free end of said piston is continuously pressed towards one of said load distributing bases between said structure and a foundation.

14. A structure as set forth in claim 13 including a plate means adjacent the free end of said piston, and friction reducing means between said free end and said plate means to permit sliding movement between said plate means and said free end in a direction parallel to said load distributing bases.

15. A structure as set forth in claim 14 in which said friction reducing means comprises polytetrafluoroethylene plastic.

16. A structure as set forth in claim 1 in which said other elastic means includes a column of elastomeric material, a cylinder secured to one end of said column and extending axially from said one end, a tube slidably receiving said cylinder, means for securing the free end of said column to one of the components connected by said other elastic means, and means for securing said tube to the other of the components connected by said other elastic means, whereby, upon movement between said components substantially parallel to said load distributing bses, said cylinder slides along said tube without transmitting forces substantially axially of said column of elastomeric material.

17. A structure as set forth in claim 16 including friction reducing means between said cylinder and said tube.

18. A pot bearing for use in base isolation of a structure comprising a cylinder which has a opening at one end a piston slidable through said opening and along said cylinder and having a free end, an elastomeric mass within said cylinder, a support member extending inwardly from the interior wall of said cylinder, between its ends, to support said elastomeric means when it is compressed by said piston and spring means extending through said support member to urge said elastomeric mass against the other end of said piston, whereby the free end of said piston is continuously pressed against a structure in case of movement, along the axis of said bearing, between said structure and a foundation.

19. A pot bearing as set forth in claim 18 including a plate means adjacent the free end of said piston, and friction reducing means between said free end and said plate means to permit sliding movement between said plate means and said free end in a direction perpendicular to the axis of the bearing.

20. A pot bearing as set forth in claim 19 in which said friction reducing means comprises polytetrafluoroethylene plastic.

21. A connecting device for use in base isolation of a structure comprising a cylinder a piston slidable along said cylinder fluid connecting means for transfer of fluid between spaces at the oppostie sides of said piston to permit transfer of fluid between said spaces when movement of said piston displaces said fluid, a piston rod connected to said piston and extending from said cylinder in a first direction, said piston rod being constructed and arranged to be connectable to a part of said structure, means for connecting said cylinder to another part of said structure, said cylinder-connecting means including coupling means for disconnecting said cylinder from said other part of said structure when subjected to a predetermined force, whereby the connecting device will permit slow movement between the respective parts of said structure, but will disconnect when said predetermined force is applied to said coupling means.

22. A connecting device as set forth in claim 21 in which said fluid connecting means is a small diameter pipe whose diameter is smaller than the diameter of said cylinder.

23. A connecting device as set forth in claim 21 wherein said coupling means is a rod extending through a wall of said cylinder, said rod having a notch whereat said rod will break upon application of said predetermined force.

24. An elastomeric spring device for controlling horizontal movements of a structure, said device comprising a column of elastomeric material, a cylinder secured to one end of said column and extending axially from said one end, a tube alidably receiving said cylinder, means for securing the free end of said column to one part of a structure, and means for securing said tube to another part of said structure, whereby, upon movement between the two parts of a structure to which said elastomeric spring device has been attached, perpendicular to the axis of said elastomeric column, said cylinder slides along said tube.

25. An elastomeric spring device as set forth in claim 24 including friction reducing means between said tube and said cylinder.

* * * * *